United States Patent [19]

Sturges et al.

[11] 4,053,021

[45] Oct. 11, 1977

[54] SIDE-BY-SIDE TRACTOR COMBINATION

[75] Inventors: James R. Sturges, Washington; Willis R. Daft, Peoria, both of Ill.

[73] Assignee: Caterpillar Tractor Co., Peoria, Ill.

[21] Appl. No.: 675,027

[22] Filed: Apr. 8, 1976

[51] Int. Cl.[2] ..... E02F 3/76

[52] U.S. Cl. ..... 172/801; 180/14 B

[58] Field of Search ..... 172/801, 805, 806, 802, 172/807; 180/6.48, 14; 280/413

[56] References Cited

U.S. PATENT DOCUMENTS

| | | | |
|---|---|---|---|
| 2,113,997 | 4/1938 | Starr | 172/801 |
| 2,821,795 | 2/1958 | Williams | 180/6.48 X |
| 3,601,210 | 8/1971 | Stedman | 180/14 |
| 3,661,214 | 5/1972 | Peterson | 172/801 |
| Re. 24,175 | 7/1956 | Peterson | 180/6.48 |

*Primary Examiner*—Richard J. Johnson

*Attorney, Agent, or Firm*—Phillips, Moore, Weissenberger, Lempio & Majestic

[57] ABSTRACT

A pair of tractors are disposed in side-by-side relation, and are coupled by a single rigid link which may be reversed in position to vary the relative positioning of the tractors forwardly and rearwardly, to in turn determine the positioning of an implement carried by the tractors.

4 Claims, 3 Drawing Figures

SIDE-BY-SIDE TRACTOR COMBINATION

BACKGROUND OF THE INVENTION

This invention relates to tractors, and more particularly to the combining of a plurality of separable tractor vehicles for operation as a unitary tractor device for powering a common load.

In earthworking projects and other operations of the type in which tractors are employed, there is a continuing demand for increased tractive effort to power larger working implements or to apply more force to existing equipment. Reclamation mining, for example, requires the moving of large volumes of overburden and can be greatly facilitated through the use of large bulldozers and related equipment.

In theory, greater tractive effort can be provided for by scaling up the size of existing tractor designs. In practice, several serious difficulties may be encountered in using this approach to the problem. Very large tractors are extremely expensive to construct and operate, and are therefore limited to certain specialized applications in which high costs can be justified. Further, serious problems arise in connection with transporting a very large tractor from one job site to another.

For these reasons, it is frequently preferable to combine two or more smaller tractors into a unitized assembly for powering a single load. The component tractors of such a unit may be disengaged from each other when necessary for separate use, maintenance, and for shipping purposes.

U.S. Pat. No. 3,661,214 to Peterson et al, assigned to the assignee of this invention, discloses a system wherein multiple tractors are connected by an extensible and retractable cylinder which can be so extended and retracted to vary the relative positions between the tractors to in turn provide for angling of a working implement such as a bulldozer blade, with the maximum angle of the working surface of such blade being approximately 20°. It has been found desirable, to provide high efficiency in earthmoving, to provide that the working surface of the blade is approximately 40° or more from a line transverse of the longitudinal axes of the tractors in the apparatus, i.e. approximately 40° or more from a line perpendicular to the direction of movement of the tractors of the apparatus.

As will be discussed in detail further on, such relatively extreme angling cannot be achieved in the apparatus of U.S. Pat. No. 3,661,214 since the cylinder thereof cannot extend or retract sufficiently to provide such angling, and furthermore, the forward and rearward coupling elements thereof would interfere with the bodies of the tractors, even if the cylinder could achieve such angling.

SUMMARY AND OBJECTS OF THE INVENTION

It is accordingly an object of this invention to provide a multiple tractor combination which is capable of angling the working surface of a blade approximately 40° from a line transverse of the longitudinal axes of the tractors.

It is a further object of this invention to provide a multiple tractor unit which includes a blade, the working surface of which may be positioned substantially transversely of the longitudinal axes of the tractors.

Broadly stated, the invention comprises a multiple tractor assembly comprising first and second tractors in generally side-by-side and parallel relation, a first coupler element interconnecting the respective rearward ends of the tractors through pivotal joints, a second coupler element interconnecting the respective forward ends of the tractors through pivotal joints and comprising a working implement, and rigid link means connectable to said first and second tractors to be coupled to one of said tractors at a point forwardly of the coupling to the other tractor to determine with said first and second coupler elements a first relative position of the first and second tractors to in turn determine a first position of the working implement relative to the longitudinal axes of the tractors, and connectable to said first and second tractors to be coupled to the other of said tractors at a point forwardly of the coupling to the one of said tractors to determine with said first and second coupler elements a second relative position of the first and second tractors to in turn determine a second position of the working implement relative to the longitudinal axes of the tractors.

BRIEF DESCRIPTION OF THE DRAWINGS

These and other objects of the invention will become apparent from a study of the following specification and drawings, in which.

DESCRIPTION OF THE PREFERRED EMBODIMENT

Figure 2:
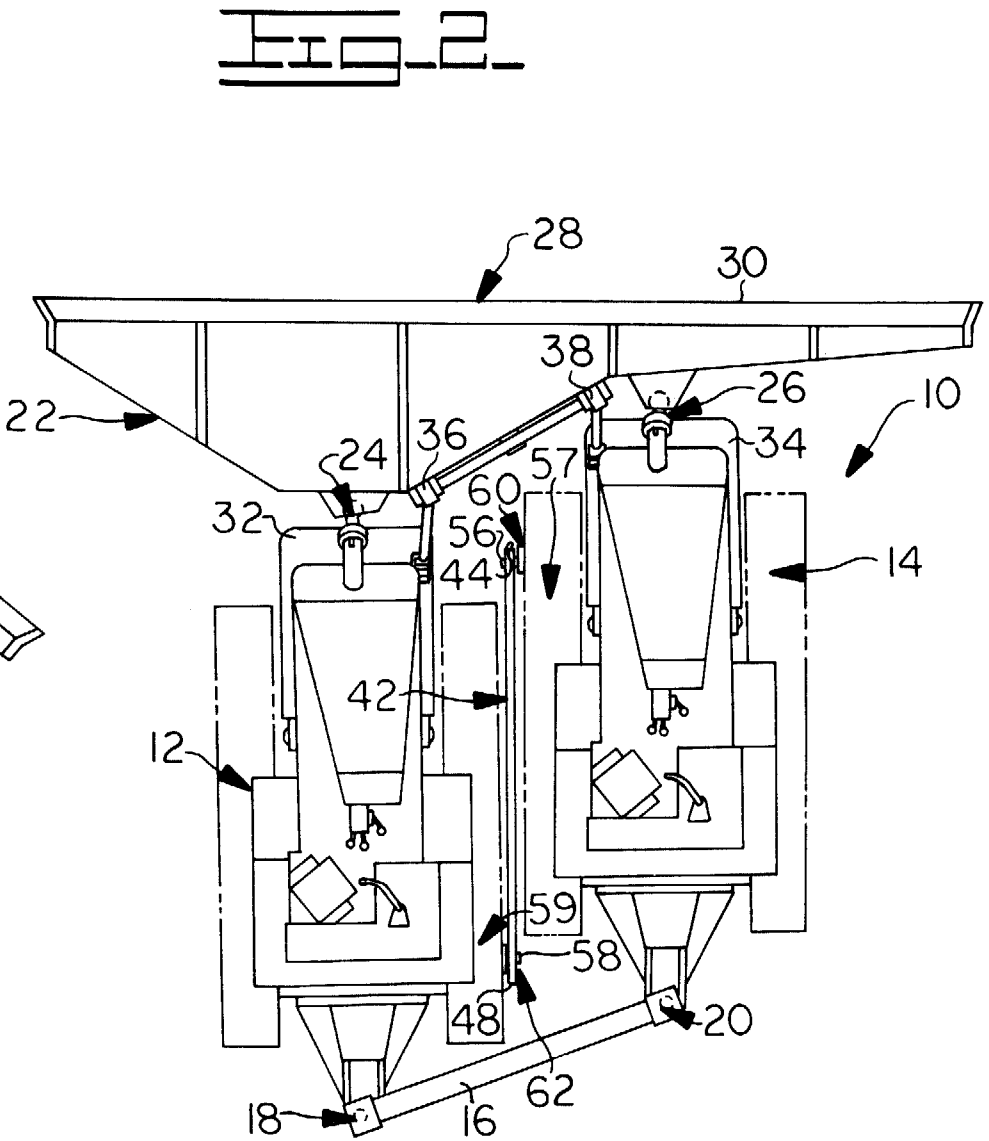
FIG. 2 is a view similar to that shown in FIG. 1, but with the tractors in a second relative position.
Figure 1:
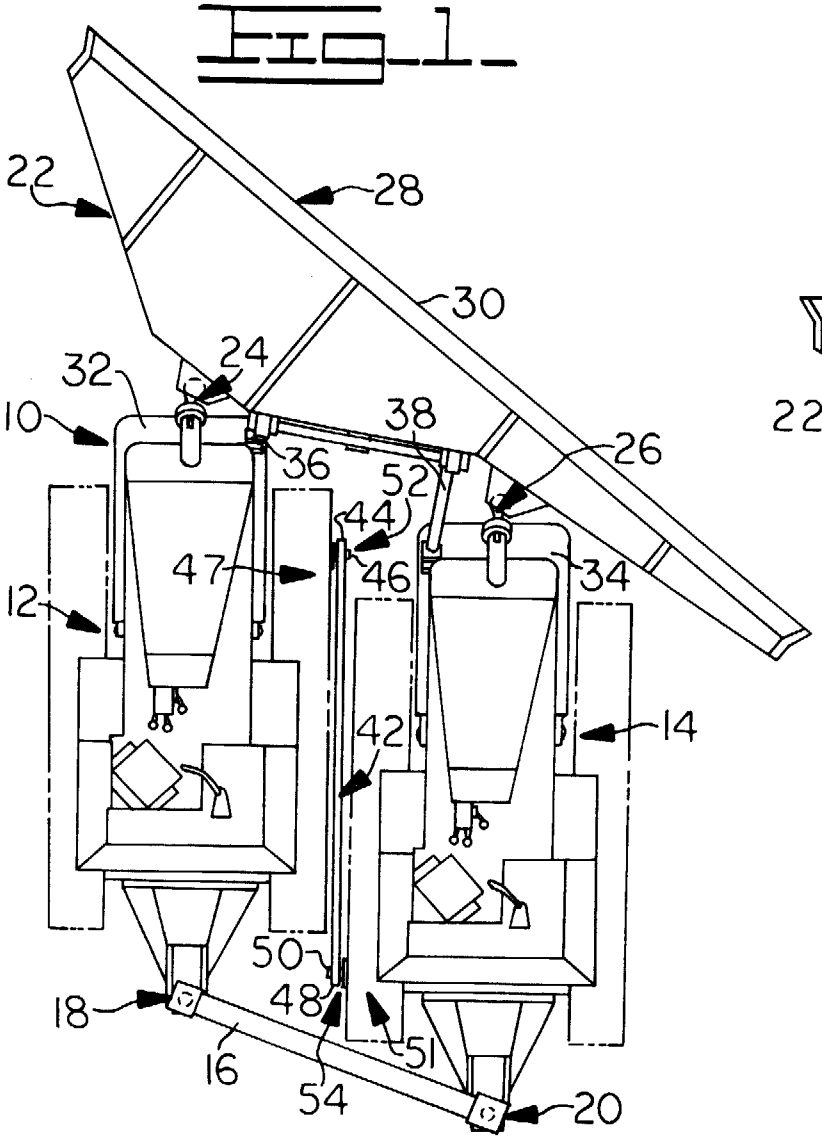
FIG. 1 is a plan view of the preferred embodiment of the invention in which two tractor vehicles are in a first relative position.

Shown in FIGS. 1 and 2 is a multiple tractor assembly 10 including first and second tractors 12, 14 in side-by-side relation, with the longitudinal axes thereof parallel. It will be seen that the tractors 12, 14 may be crawler tractors of generally conventional design. A coupler element 16 interconnects the respective rearward ends of the tractors 12, 14 through pivotal joints 18, 20. Another coupler element 22 interconnects the respective forward ends of the tractors 12, 14 through pivotal joints 24, 26, the coupler element 22 actually comprising a blade 28 defining a working surface 30, connected to the respective C frames 32, 34 of the tractors 12, 14. Additional bars 36, 38 also interconnect the C frames 32, 34 and the blade 28. It is to be noted that the working surface 30 of the blade 28 is angled 20° relative to a straight line connecting the pivotal joints 24, 26.

A single rigid link 42 is positioned between the tractors 12, 14 (FIG. 1), with one end 44 of the link 42 being coupled to a trunnion 46 to a track roller frame 47 adjacent a front idler of one tractor 12, and with the other end 48 being connected to a trunnion 50 fixed to a track roller frame 51 adjacent a drive sprocket of the other tractor 14. Referring to such FIG. 1, the coupling at 52 to the tractor 12 is at a point forward of the coupling at 54 to the other tractor 14. The link 42 is also pivotable relative to the tractor 12 about an axis transverse to roller frame 47, and the link 42 is also pivotable relative to the tractor 14 about an axis transverse to the roller frame 51, but the ends 44, 48 of the link 42 are not pivotable relative to the respective tractors 12, 14 in any other direction.

With such link 42 placed as described and shown in FIG. 1, the tractor 12 is approximately 50 inches ahead of the tractor 14, and the coupler elements 16, 22 are angled as shown so that the working surface 30 of the blade 28 is angled substantially 40° relative to a position thereof wherein the working surface 30 of the blade 28 is generally transverse of the longitudinal axes of the tractors 12, 14 as shown in FIG. 2. Thus, the working surface 30 of the blade 28 is properly positioned for highly efficient moving of earth under certain conditions as previously described. That is to say, the positioning of the first and second tractors 12, 14, determined by the positioning of the coupler elements 16, 22 and link 42, determines a first position of the working element 28 relative to the longitudinal axes of the tractors 12, 14. With the tractors 12, 14 so positioned, only a small space is provided therebetween, and the longitudinal axis of the link 42 is substantially parallel to the longitudinal axes of the tractors 12, 14.

If it is desired that the blade 28 be moved to the position shown in FIG. 2, the link 42 is removed from the tractor 12 and tractor 14, and the tractor 14 is moved forwardly of the tractor 12. The link 42 is placed in a position wherein end 44 is coupled to a trunnion 56 fixed to a track roller frame 57 adjacent an idler of the tractor 14, and the end 48 is coupled to a trunnion 58 fixed to a track roller frame 59 adjacent a drive sprocket of the tractor 12. The coupling 60 to the tractor 14 is now forward of the coupling 62 to the tractor 12, and the link 42 is again pivotally connected to the trunnion 56 and trunnion 58 in a manner similar to the pivotal connections to the trunnion 46 and trunnion 50. The link 42 is again positioned substantially parallel to the longitudinal axes of the tractors 12, 14 with the tractors 12, 14 now in a second relative position. In such second relative position, the tractor 14 is now positioned approximately 50 inches ahead of the tractor 12, which is just the reverse of the positioning previously described.

As shown in FIG. 2, the coupler elements 16, 22 and link 42 determine such second relative position of the tractors 12, 14 to in turn determine another position of the blade 28 relative to the longitudinal axes of the tractors 12, 14. In such state, the working surface 30 of the blade 28 is positioned generally transversely of the longitudinal axes of the tractors 12, 14.

Figure 3:
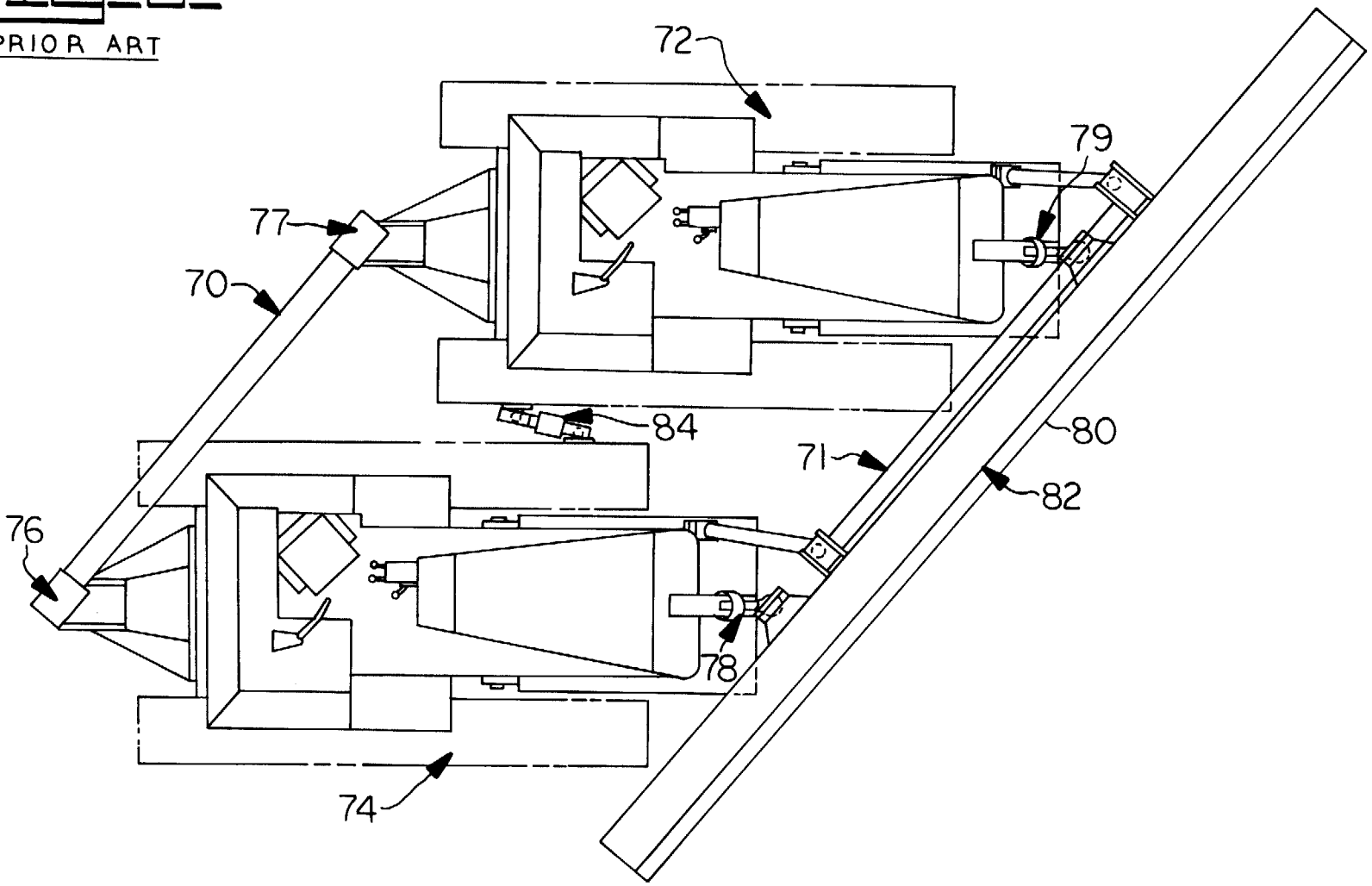
FIG. 3 PRIOR ART
FIG. 3 is a view similar to that shown in FIGS. 1 and 2, but of a prior art system incorporating side-by-side tractors.

Shown in FIG. 3 is a system of the type disclosed in U.S. Pat. No. 3,661,214, including coupler elements 70, 71 connected to the tractors 72, 74 by means of pivotal connections 76, 77, 78, 79, the working surface 80 of the blade 82 of the coupler element 71 being parallel to a straight line connecting the pivotal joints 78, 79. The tractors 72, 74 are connected by an extensible and retractable cylinder 84, and it will be seen that the achievement of the angling of the working surface 80 of the blade 82 at 40°, similar to that shown in FIG. 1, would require that the cylinder 84 be retracted to the extent shown in FIG. 3, obviously an impossibility, or be extended to a point well beyond the capability thereof. Also, such angling of the working surface 80 of the blade 82 would result in the coupler element 70 interfering with the rearward portion of the tractor 74, and would also result in the coupler element 71 interfering with the C-shaped frames of the tractors 72, 74.

We claim:

1. A multi-tractor assembly comprising first and second tractors in generally side-by-side and parallel relation, a first coupler element interconnecting the respective rearward ends of the tractors through pivotal joints, a second coupler element comprising a working implement comprising a blade defining a working surface, mounting means for pivotally mounting the second coupler element to the respective forward end of the tractors, and fixed length rigid link means connectable to said first and second tractors to be coupled to one of said tractors at a point forwardly of the coupling to the other tractor to determine with said first and second coupler elements a first relative position of the first and second tractors with the first tractor forward of the second tractor to in turn determine a first position of the working implement relative to the longitudinal axis of the tractors, and said rigid link also being connectable to said first and second tractors to be coupled to the other of said tractors at a point forwardly of the coupling to the one tractor to determine with said first and second coupler elements a second relative position of the first and second tractors with the second tractor forward of the first tractor to in turn determine a second position of the working implement relative to the longitudinal axis of the tractors, the mounting means being positioned with respect to said working surface such that the working surface is at a predetermined angle relative to a position generally perpendicular to the longitudinal axis of the tractors with the tractors in the first relative position thereof, the working surface being positioned generally perpendicular to the longitudinal axis of the tractor with the tractors in the second relative position thereof.

2. The apparatus of claim 1 wherein the link means comprise a single rigid link positioned to be coupled to one of said tractors at a point forwardly of the coupling to the other tractor to determine with the first and second coupler elements said first relative position of the first and second tractors, and positionable to be coupled to the other of said tractors at a point forwardly of the coupling to the one of the tractors to determine with said first and second coupler elements said second relative position of the first and second tractors.

3. The apparatus of claim 2 wherein the longitudinal axis of the single link is substantially parallel to the longitudinal axes of the tractors with the tractors in their first relative positions, and with the tractors in their second relative positions.

4. The apparatus of claim 1 wherein with the tractors in the first relative position, the working surface of the blade is angled substantially 40° relative to the position thereof wherein the working surface of the blade is generally perpendicular to the longitudinal axes of the tractors.

* * * * *